US011856384B2

(12) United States Patent
Zhou et al.

(10) Patent No.: US 11,856,384 B2
(45) Date of Patent: Dec. 26, 2023

(54) SPEAKER AND ELECTRONIC DEVICE

(71) Applicant: AAC Microtech (Changzhou) Co., Ltd., Jiangsu (CN)

(72) Inventors: Keyong Zhou, Shenzhen (CN); Xudong Yan, Shenzhen (CN); Yuanxiang Mao, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 24 days.

(21) Appl. No.: 17/566,708

(22) Filed: Dec. 31, 2021

(65) Prior Publication Data

US 2023/0148010 A1 May 11, 2023

(30) Foreign Application Priority Data

Nov. 10, 2021 (CN) ..... 202122737937.5

(51) Int. Cl.

| | |
|---|---|
| ***H04R 9/06*** | (2006.01) |
| ***H04R 9/02*** | (2006.01) |
| ***H04R 9/04*** | (2006.01) |

(52) U.S. Cl.

CPC ..... *H04R 9/06* (2013.01); *H04R 9/027* (2013.01); *H04R 9/045* (2013.01); *H04R 2209/024* (2013.01); *H04R 2400/11* (2013.01); *H04R 2499/11* (2013.01)

(58) Field of Classification Search

CPC ..... H04R 9/06; H04R 9/027; H04R 9/045; H04R 2209/024; H04R 2400/11; H04R 2499/11

See application file for complete search history.

(56) References Cited

U.S. PATENT DOCUMENTS

2013/0051604 A1* 2/2013 Sakai ..... H04R 9/063 381/401

* cited by examiner

*Primary Examiner* — Tuan D Nguyen

(74) *Attorney, Agent, or Firm* — W&G Law Group

(57) ABSTRACT

A speaker including a frame; a magnetic circuit system fixed to the frame, comprises a plurality of magnetic circuit devices connected to each with a magnetic gap; a vibration system driven by the magnetic to vibrator, comprises a diaphragm fixed to the frame and a plurality of voice coil assembly inserted into the magnetic gap drive the diaphragm vibrate jointly. the speaker can drive the diaphragm to vibrate and produce sound with a greater driving force, and the magnetic circuit system has a higher magnetic field. The efficiency makes the speaker have a better sound effect.

9 Claims, 8 Drawing Sheets

A-A

SPEAKER AND ELECTRONIC DEVICE

FIELD OF THE INVENTION

The present disclosure relates to a speaker, and in particular, to an electronic device with a loudspeaker module.

BACKGROUND

Generally, an electronic device, such as a mobile phone, uses a speaker as a sound generator.

A typically speaker includes a holder having a hollow space, a magnetic system received into the hollow space, a diaphragm attached to the holder and covered on the magnetic system. The speaker in the related art has a big size due to the low magnetic efficiency.

Therefore, it is desired to provide an improved loudspeaker module for portable electronic devices.

SUMMARY

In one aspect, the present disclosure provides A speaker comprising: a frame; a magnetic circuit system fixed to the frame, comprises a plurality of magnetic circuit devices connected to each with a magnetic gap; a vibration system driven by the magnetic to vibrator, comprises a diaphragm fixed to the frame and a plurality of voice coil assembly inserted into the magnetic gap drive the diaphragm vibrate jointly.

Further, wherein the magnetic circuit devices comprises a yoke and a magnetic assembly received in the yoke; the yoke comprises a bottom wall that carries the magnetic assembly, a sidewall bending and extending from the bottom wall towards the diaphragm, and a connecting portion protruding along a direction away from the magnetic assembly; the side wall and the magnetic assembly are spaced to form the magnetic gap, the multiple magnetic circuit device are connected to each through the connecting portion.

Further, wherein two adjacent yoke are connected to each by welding and glue.

Further, wherein the yoke further comprise a magnetic circuit fixing portion fixed to the frame extending from the side wall towards a direction away from the magnetic assembly, the magnetic circuit fixing portion is spaced from the connecting portion.

Further, wherein the vibration system further comprises a elastic diaphragm assembly fixed to the frame while elastically supporting the diaphragm, the elastic diaphragm assembly comprises a elastic diaphragm fixed to the frame and an auxiliary skeleton connected with the elastic diaphragm and the diaphragm, the elastic diaphragm is spaced apart from the diaphragm along a direction that the diaphragm vibrates.

Further, wherein the voice coil assembly comprises a voice coil with a voice coil lead and a skeleton connected the voice coil and the diaphragm, the diaphragm comprises a dome with and a suspension ring portion arranged around the dome, the suspension ring portion comprises a fixing portion fixedly to the frame, a connecting portion connected to the dome, and a suspension ring connecting the fixing portion with the connecting portion, the suspension ring comprises at least one bending portion protruding along the direction that the diaphragm vibrates.

Further, wherein the dome is arranged in a rectangular shape and surrounding by the bending portion, four corners of the bending portion providing with a striped patterns recessed from the bending portion.

Further, wherein further comprises a moulding portion protruding along the direction that the diaphragm vibrates from the dome.

Further, wherein further comprises an external pad embedded in the frame and connected to an external circuit, a circuit board attached to the dome, and a braided wire electrically connects the circuit board and the external pad, the voice coil electrically connects to the circuit board through the voice coil lead.

In another aspect, the present disclosure provides an electronic device including a speaker as described above.

BRIEF DESCRIPTION OF THE DRAWINGS

In order to explain the technical solutions of the embodiments of the present disclosure more clearly, accompanying drawings used to describe the embodiments are briefly introduced below. It is evident that the drawings in the following description are only concerned with some embodiments of the present disclosure. For those skilled in the art, in a case where no inventive effort is made, other drawings may be obtained based on these drawings.

FIG. 12 is a three-dimensional view illustrates a speaker in accordance to another embodiment with the present disclosure; and.

DESCRIPTION OF THE EMBODIMENTS

Figure 1:
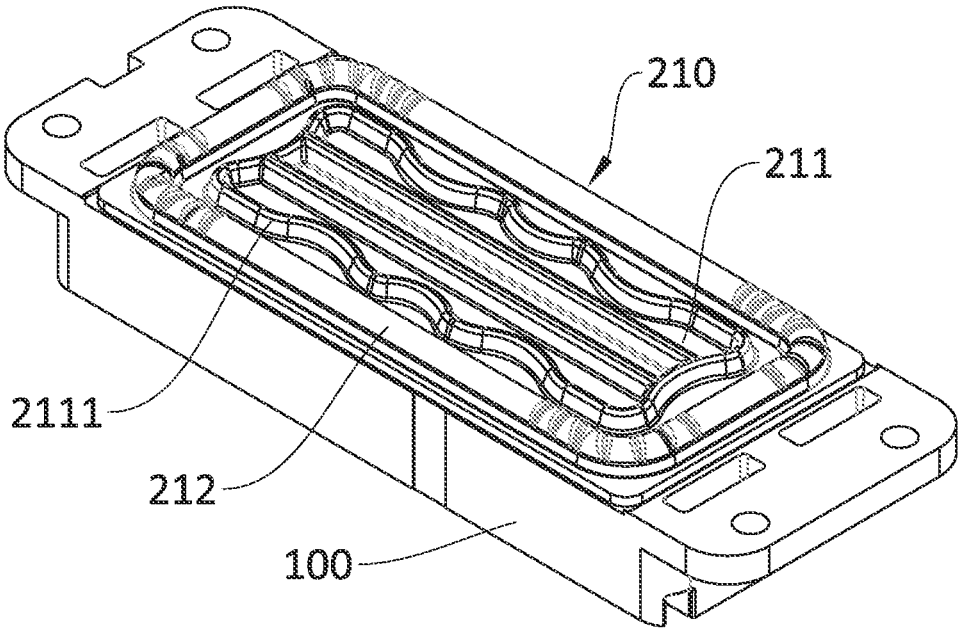
FIG. 1 is a three-dimensional view illustrates a speaker in accordance with the present disclosure.

The present disclosure will be further illustrated with reference to the accompanying drawings. It shall be noted that the elements of similar structures or functions are represented by like reference numerals throughout the figures. The embodiments described herein are not intended as an exhaustive illustration or description of various other embodiments or as a limitation on the scope of the claims or the scope of some other embodiments that are apparent to one of ordinary skills in the art in view of the embodiments described in the Application. In addition, an illustrated embodiment need not have all the aspects or advantages shown.

As shown in the FIG. 1-10. The present invention discloses a speaker, which includes a frame 100, a vibration system 200 fixed to the frame 100, and a magnetic circuit system 300 that drives the vibration system 200 to vibrate. The vibration system 200 includes a diaphragm 210 fixed to the frame 100, a plurality of voice coil assemblies 220 that drives the diaphragm 210 to vibrate and produce sound, and an elastic diaphragm assembly 230 that elastically supports the diaphragm 210. The voice coil assembly 220 includes a voice coil 221 and a skeleton 222 connected voice coil 221 and the diaphragm 210.

Figure 2:
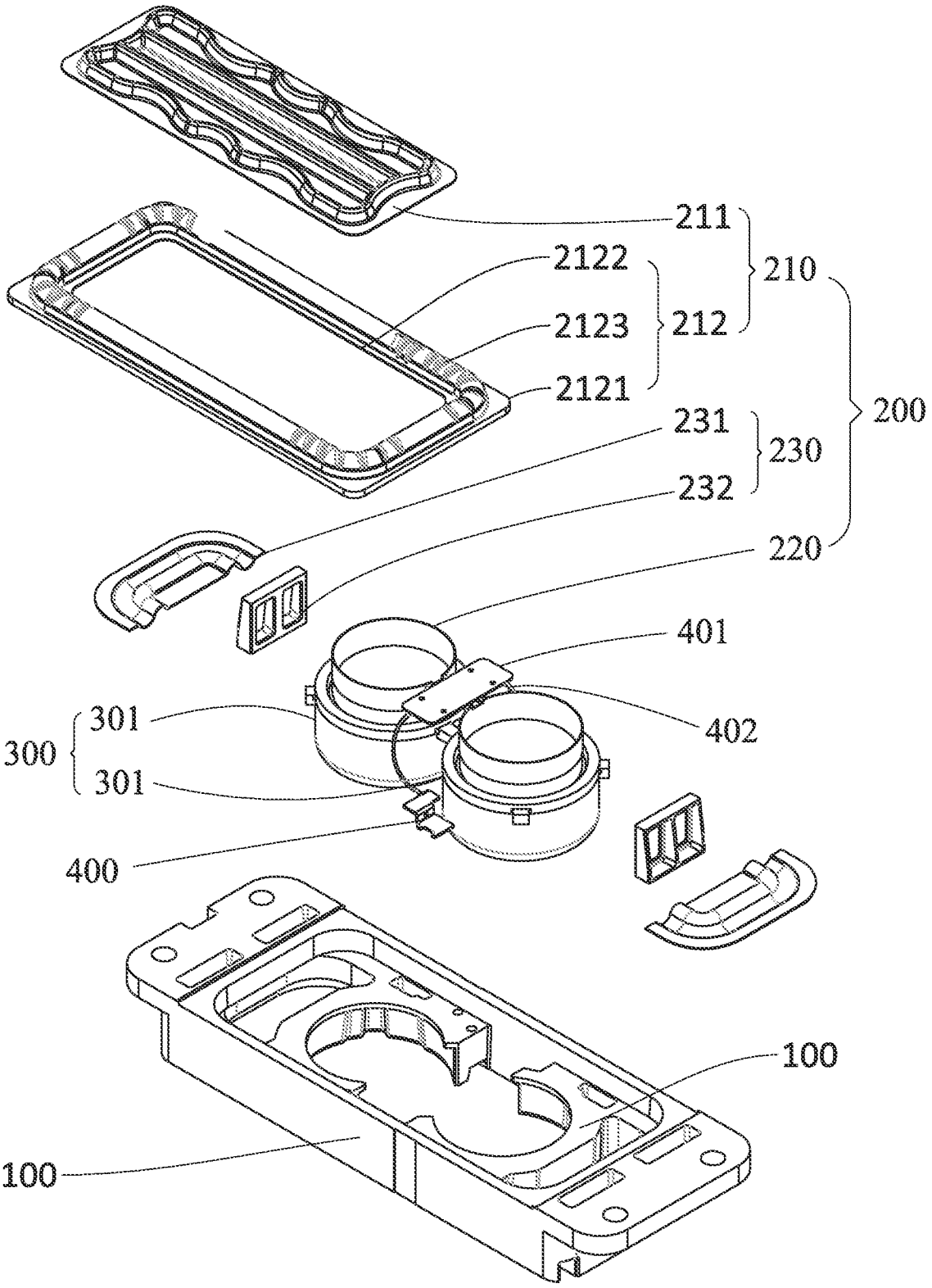
FIG. 2 is a explode view of the speaker shown in FIG. 1.
Figure 3:
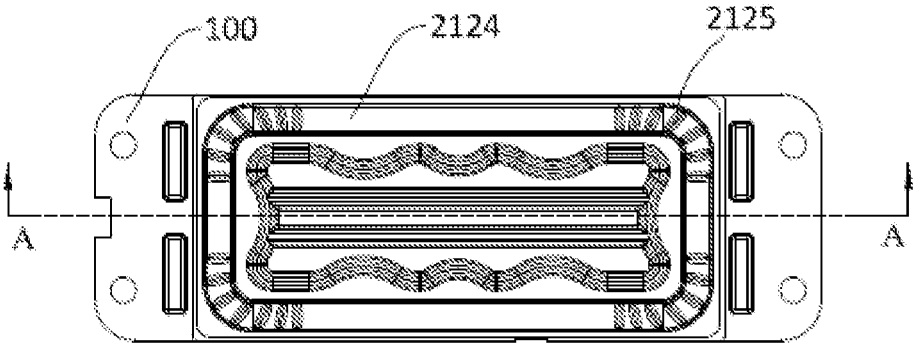
FIG. 3 is a top view of the speaker shown in FIG. 1.
Figure 11:
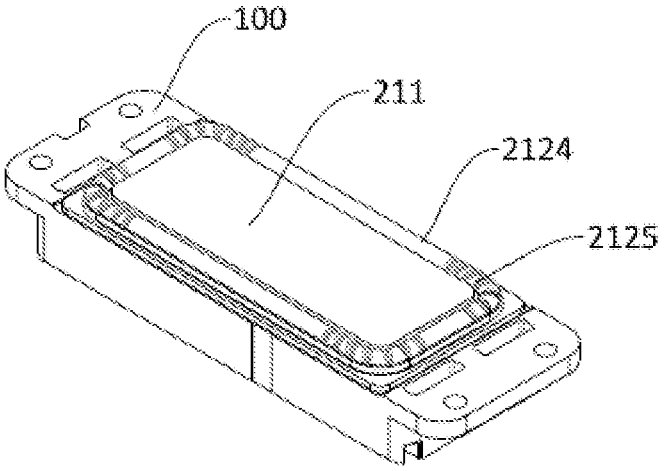
FIG. 11 is a three-dimensional view illustrates a speaker in accordance to another embodiment with the present disclosure.
Figure 12:
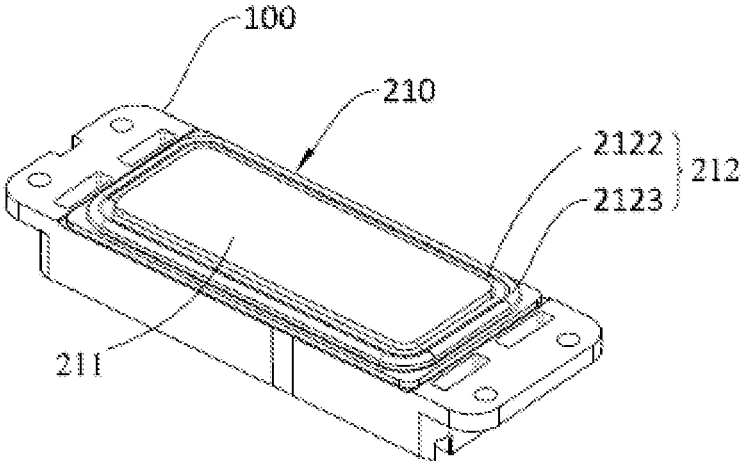
Figure 13:
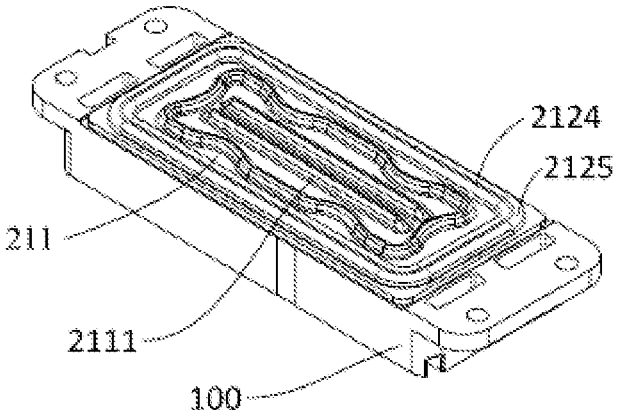
FIG. 13 is a three-dimensional view illustrates a speaker in accordance to another embodiment with the present disclosure.

In the present embodiment, the diaphragm 210 includes a dome 211 and a suspension ring portion 212 arranged around the dome 211. As shown in FIG. 2, dome 211 is arranged in a rectangular structure and has a moulding portion 2111 protruding along the vibration direction. Such a setting is beneficial to optimize the vibration mode of the diaphragm, obtain better high-frequency performance, making it has a better vibration and sound effect. In other optional implementation, the moulding portion 2111 may also be formed recessed from the dome 211. In some optional embodiments, as shown in FIGS. 11 to 12, the dome 211 may also be configured as a flat plate. The suspension ring portion 212 includes a fixing portion 2121 that is fixedly connected to the frame 100, a connecting portion 2122 connected to the dome 211, and a suspension ring 2123 connecting the fixing portion 2121 and the connecting portion 2122. The suspension ring 2123 includes a bending portion 2124 protruding along the vibration direction, and four corners of the bending portion 2124 are provided with striped patterns 2125 recessed from the bending portion 2124. Such a setting can effectively improve the problem of easy discounting at the corners when the diaphragm 210 vibrates up and down, and effectively improve the balance and stability of the vibration of the diaphragm, the pure tone, distortion and swing of the speaker, and enable the speaker to obtain better acoustic performance. In other optional embodiments, as shown in FIG. 13, the suspension ring may further include two bending portions 2124 protruding along the vibration direction. the suspension ring portion 212 is made of rubber, silica gel, or foamed material. The dome 211 is made of a single-layer composite material or a multi-layer composite material. The material of dome 211 includes but is not limited to carbon fibre, aluminium foil, fibre paper and foam.

Figure 4:
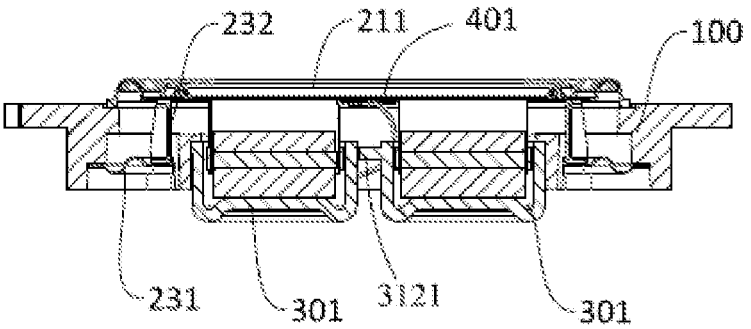
FIG. 4 is a cross-sectional view along the line A-A in FIG. 3.

As shown in FIGS. 2 and 4, the elastic diaphragm assembly 230 includes an elastic diaphragm 231 fixed to the frame 210 and an auxiliary skeleton 232 connected with the elastic diaphragm 231 and the diaphragm 210. The elastic diaphragm 231 is spaced apart from the diaphragm 210 along the vibration direction of the vibration system 200. By providing the elastic diaphragm assembly 230 that elastically supports the diaphragm 210, the diaphragm 210 can be effectively restrained from swinging laterally during the vibration and sound production process, thereby improving the sound effect of the speaker. Further, the material of the elastic diaphragm 231 may be mesh cloth, rubber, etc., making the elastic diaphragm 231 can better elastically support the diaphragm 210.

The magnetic circuit system 300 includes a plurality of magnetic circuit devices 301. Each magnetic circuit device 301 includes a yoke 310 and a magnetic assembly 320 contained in the yoke 310. The yoke 310 includes a bottom wall 311 that carries the magnetic assembly 320. The bottom wall 311 and the sidewall 312 bent and extended from the bottom wall 311, the magnetic assembly 320 and the sidewall 312 are spaced to form a magnetic gap 340, and the multiple voice coil assemblies 220 are arranged in one-to-one correspondence with the multiple magnetic circuit devices 301. They are respectively inserted into the magnetic gap 340 to jointly drive the diaphragm 210 to vibrate and produce sound. The correspondingly arranged multiple magnetic circuit devices 301 and multiple voice coil assemblies 220 jointly drive the diaphragm 210 to vibrate and produce sound so that the speaker can drive the diaphragm to vibrate and produce sound with a greater driving force. The magnetic circuit system 300 has a higher magnetic field. The efficiency makes the speaker have a better sound effect, and this arrangement is also conducive to the miniaturization of the speaker. When the speaker of the present invention is applied to a car, it can be used as a car speaker, which can meet the parameter requirements of the car speaker for high sound quality, small size and flexible layout, low power consumption and small vibration.

Figure 7:
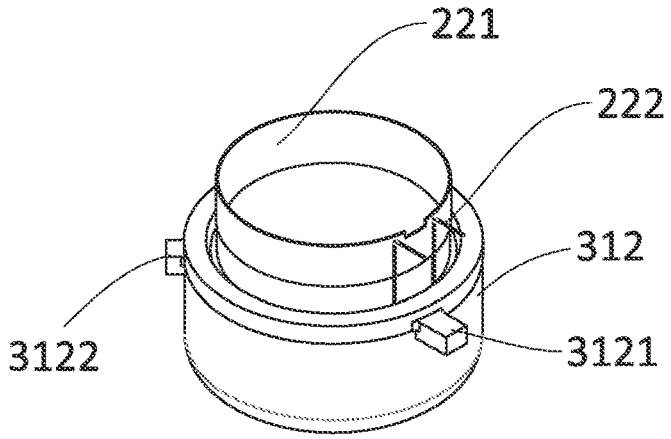
FIG. 7 is a three-dimensional view of the magnetic circuit device of the magnetic circuit system show in the FIG. 6.
Figure 8:
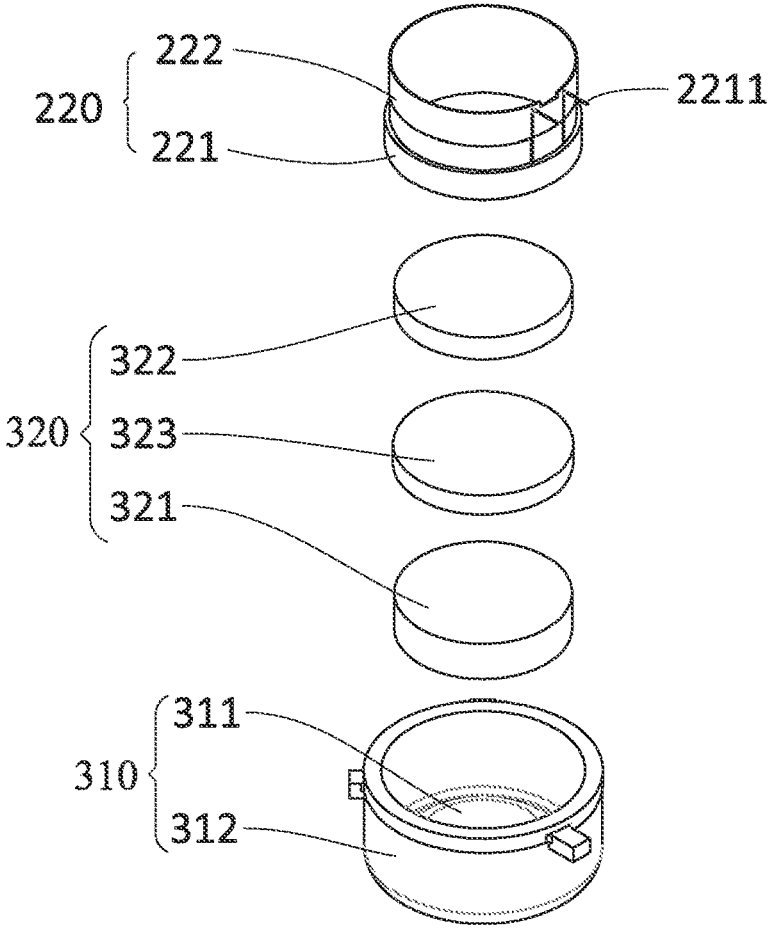
FIG. 8 is a explode view of the magnetic circuit device shown in the FIG. 7.
Figure 9:
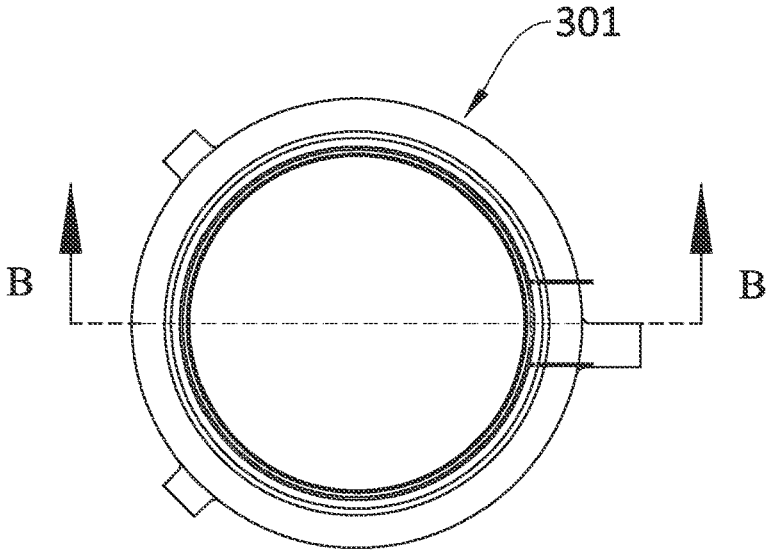
FIG. 9 is a top view of the magnetic circuit device shown in the FIG. 7.
Figure 10:
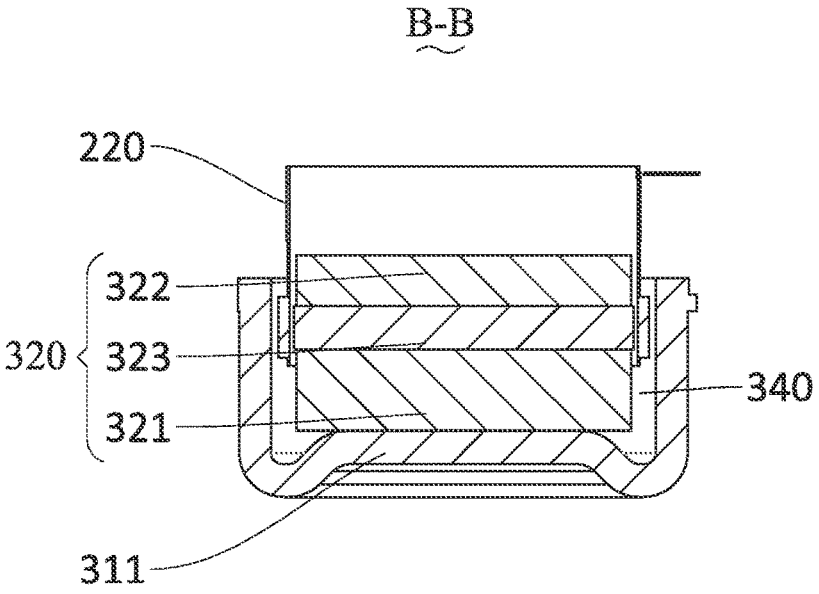
FIG. 10 is a cross-sectional view along the line B-B in FIG. 9.

As shown in FIG. 7-8, the bottom wall 311 of the yoke 310 is set in a circular shape, and the corresponding side wall 312 is set in a hollow cylinder. It is understood that, in other optional implementations, the yoke 310 can be set to other geometric forms. The sidewall 312 away from the magnetic assembly 320 is protruding provided with a connecting portion 3121 and a magnetic circuit fixing portion 3122. The connecting portion 3121 and the magnetic circuit fixing portion 3122 are arranged at intervals along the ring direction. The yoke 310 is positioned and fixedly connected to the frame 100 via the magnetic circuit fixing portion 3122 so that the communicating parts 3121 on two adjacent yoke 310 can be accurately aligned, improving the assembly accuracy and the bonding strength of the magnetic circuit device 301 and the frame 100. The communicating portion 3121 has a longer length than the fixed portion 3122 in the radial direction, and the communicating portions 3121 of two adjacent yoke are connected to each other by welding and sealing glue, and the two adjacent magnetic circuit devices 301 are thus fixedly connected to each other, so that The magnetic circuit system 300 has higher structural strength, thereby improving the overall structural stability of the speaker.

In this implementation, the magnetic circuit device 301 includes two arranged side by side. Certainly, in some other optional embodiments, the magnetic circuit device 301 can also be provided with three, four or more. The setting position can be adjusted according to the specific design of the speaker and the application field of the product.

The frame 100 has a rectangular parallelepiped shape, so that the speaker has a rectangular parallelepiped shape, and a plurality of magnetic circuit devices 301 are arranged in the inner cavity of the frame 100 along the length direction of the frame 100. Specifically, the frame is provided with a plurality of installation grooves 101, and a plurality of magnetic circuit devices 301 are correspondingly provided in each installation groove 101.

The magnetic assembly 320 includes a first magnet 321 and a second magnet 322 arranged oppositely, and a pole core 323 sandwiched between the first magnet 321 and the second magnet 322. The first magnet 321, a pole core 323, and a second magnet 322 are sequentially stacked on the bottom wall 311 of the yoke 310. The side of the first magnet 321 and the second magnet 322 close to the pole core 323 is set as a magnetic pole.

In the present embodiment, the magnetic field strength is provided by the first magnet 321 and the second magnet 322, passing through the pole core 323, the yoke 310 forms a closed magnetic field so that the voice coil 221 can reciprocate in the magnetic gap of 340.

Figure 5:
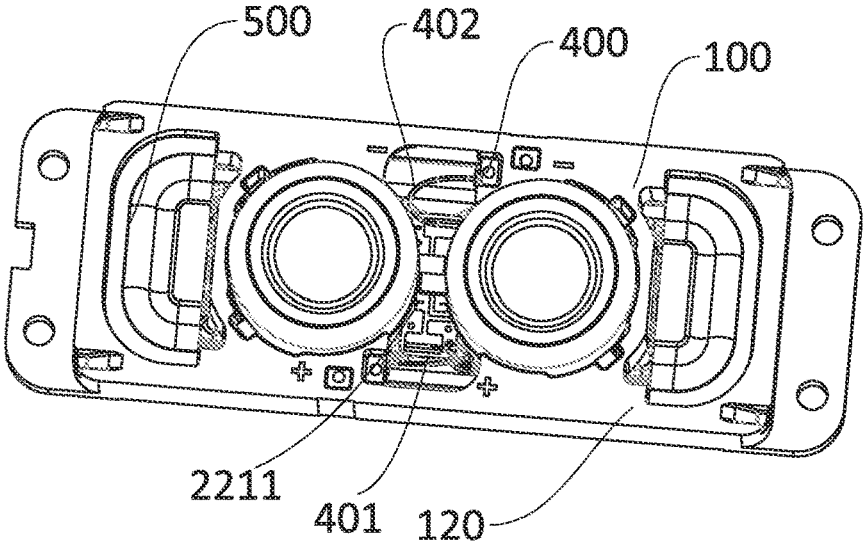
FIG. 5 is a three-dimensional view of the speaker shown in a different angle in FIG. 1.
Figure 6:
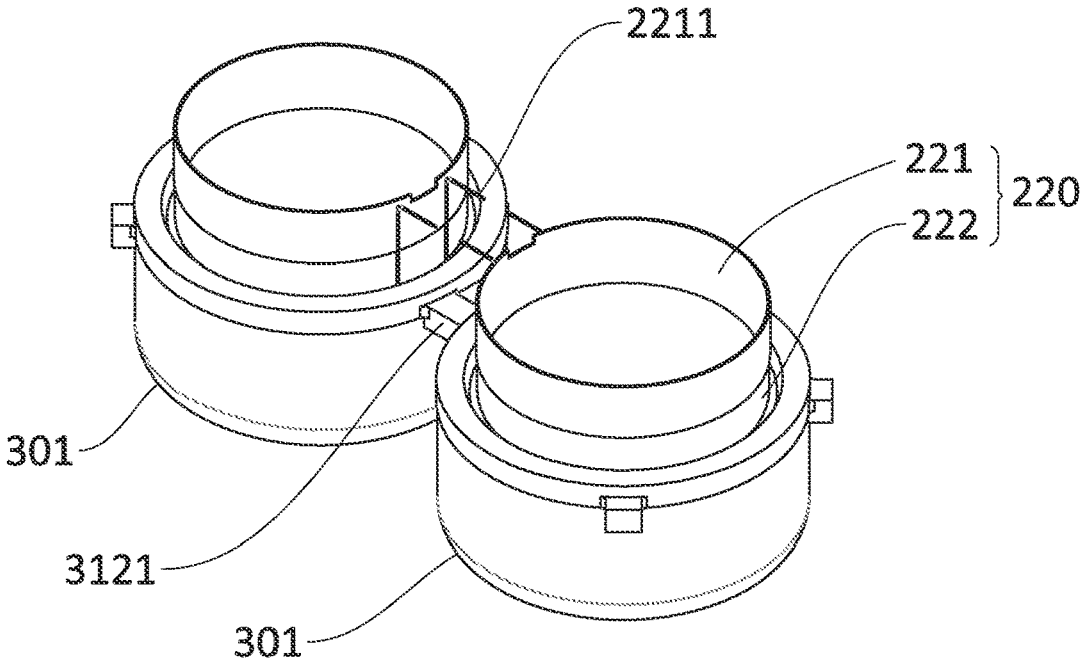
FIG. 6 is a three-dimensional view of the magnetic circuit system of the speaker shown in FIG. 1.

As shown in FIGS. 4 and 5, the speaker further includes an external pad 400 embedded in the frame 100 and connected to an external circuit, and a circuit board 401 attached to the dome 211, and the braided wire 402 that electrically connects the circuit board 401 and the external pad 400. The voice coil 221 is electrically connected to circuit board 401 through the voice coil lead 2211 to realize the electrical connection between the voice coil 221 and the external circuit. This arrangement saves valuable design space inside the speaker, facilitates the miniaturization of the speaker design, and enables the speaker to have a more stable circuit connection.

Referring to the FIG. 1-13. This practical new type also provides a type of electrical device, which includes any implementation examples above.

In the speaker provided by the practical new type, multiple magnetic circuit devices jointly drive the vibration system to vibrate and produce sound so that the speaker has a higher magnetic field efficiency, which is beneficial to the miniaturization of the speaker. In addition, because the multiple magnetic circuit devices are fixedly connected to each other, so the magnetic circuit system has higher structural strength, thereby improving the overall structural stability of the speaker. Although the invention is described with reference to one or more embodiments, the above description of the embodiments is used only to enable people skilled in the art to practice or use the invention. It should be appreciated by those skilled in the art that various modifications are possible without departing from the spirit or scope of the present invention. The embodiments illustrated above should not be interpreted as limits to the present invention, and the scope of the invention is to be determined by reference to the claims that follow.

What is claimed is:

1. A speaker comprising:

a frame;

a magnetic circuit system fixed to the frame, comprises a plurality of magnetic circuit devices connected to each with a magnetic gap;

a vibration system driven by the magnetic to vibrator, comprises a diaphragm fixed to the frame and a plurality of voice coil assembly inserted into the magnetic gap drive the diaphragm vibrate jointly;

wherein the magnetic circuit devices comprises a yoke and a magnetic assembly received in the yoke; the yoke comprises a bottom wall that carries the magnetic assembly, a sidewall bending and extending from the bottom wall towards the diaphragm, and a connecting portion protruding along a direction away from the magnetic assembly; the side wall and the magnetic assembly are spaced to form the magnetic gap, the multiple magnetic circuit device are connected to each through the connecting portion.

2. The speaker as described in claim 1, wherein two adjacent yoke are connected to each by welding and glue.

3. The speaker as described in claim 1, wherein the yoke further comprises a magnetic circuit fixing portion fixed to the frame extending from the side wall towards a direction away from the magnetic assembly, the magnetic circuit fixing portion is spaced from the connecting portion.

4. The speaker as described in claim 1, wherein the vibration system further comprises an elastic diaphragm assembly fixed to the frame while elastically supporting the diaphragm, the elastic diaphragm assembly comprises a elastic diaphragm fixed to the frame and an auxiliary skeleton connected with the elastic diaphragm and the diaphragm, the elastic diaphragm is spaced apart from the diaphragm along a direction that the diaphragm vibrates.

5. The speaker as described in claim 1, wherein the voice coil assembly comprises a voice coil with a voice coil lead and a skeleton connected the voice coil and the diaphragm, the diaphragm comprises a dome with and a suspension ring portion arranged around the dome, the suspension ring portion comprises a fixing portion fixedly to the frame, a connecting portion connected to the dome, and a suspension ring connecting the fixing portion with the connecting portion, the suspension ring comprises at least one bending portion protruding along the direction that the diaphragm vibrates.

6. The speaker as described in claim 5, wherein the dome is arranged in a rectangular shape and surrounding by the bending portion, four corners of the bending portion providing with a striped patterns recessed from the bending portion.

7. The speaker as described in claim 5, wherein further comprises a moulding portion protruding along the direction that the diaphragm vibrates from the dome.

8. The speaker as described in claim 5, wherein further comprises an external pad embedded in the frame and connected to an external circuit, a circuit board attached to the dome, and a braided wire electrically connects the circuit board and the external pad, the voice coil electrically connects to the circuit board through the voice coil lead.

9. An electronic device, comprising a speaker described in claim 1.

* * * * *